US005855170A

United States Patent [19]

Shih

[11] Patent Number: 5,855,170

[45] Date of Patent: Jan. 5, 1999

[54] INK-REPLENISHABLE SIGNET

[76] Inventor: Shiny Shih, No. 31, Lane 349, Chungcheng S. Rd., Yungkang City, Tainan Hsien, Taiwan

[21] Appl. No.: 989,924

[22] Filed: Dec. 12, 1997

[30] Foreign Application Priority Data

Oct. 20, 1997 [TW] Taiwan ..... 86217685

[51] Int. Cl.[6] ..... B41F 31/00

[52] U.S. Cl. ..... 101/327; 101/333

[58] Field of Search ..... 101/327, 405, 101/368, 371, 333

[56] References Cited

U.S. PATENT DOCUMENTS

| | | | |
|---|---|---|---|
| D. 376,383 | 12/1996 | Harden | 101/327 |
| 3,478,682 | 11/1969 | Funahashi | 101/368 |
| 3,885,495 | 5/1975 | Funahashi | 101/327 |
| 4,676,162 | 6/1987 | Phipps | 101/405 |

*Primary Examiner*—Edgar Burr
*Assistant Examiner*—Anthony H. Nguyen
*Attorney, Agent, or Firm*—William E. Pelton, Esq.

[57] ABSTRACT

An ink-replenishable signet comprises a body, a reciprocal shield movably receiving the body, a grip portion mounted on the reciprocal shield and a bottom cover mounted to a bottom of the body. The body includes a pedestal, two rectangular tubes extending integrally and upwardly from the pedestal and a post formed between the two rectangular tubes. The pedestal further has two stepped portions respectively formed at two sides thereof and an ink reservoir and a stamp block received therein. A stop is mounted to the two stepped portions of the pedestal for restricting the movement of the stamp block. The expansion has an enclosure extending integrally from a top face thereof. The top face of the reciprocal shield defines an aperture and two holes therein for the post and two rectangular tubes of the pedestal to be respectively extending therethrough and then is engaged with a clip member. Yuan Yunqiu

10 Claims, 6 Drawing Sheets

INK-REPLENISHABLE SIGNET

BACKGROUND OF THE INVENTION

1. Field of the Invention

The present invention relates to an signet, and more particularly to an ink-replenishable signet which has an even and stable ink output.

2. Description of Related Art

A conventional signet is generally designed with a grip portion and a stamp block. When in use, it is necessary for the signet to be constantly re-inked by means of a separate ink pad. Later, signets with ink reservoirs were developed. A typical example of this signet is shown in FIG. 7. The signet includes a body 80, a grip portion 81 mounted on the body 80, a reciprocal shield 83 movably mounted to a lower portion of the body 80, and a housing 82 mounted around the body 80. The body 80 has an ink reservoir 801 and a stamp block 802 formed at a bottom end thereof. A cover 84 can be used for protecting the stamp block when the signet is not in use. To stamp a document, the grip portion 81 is pressed down whereby the reciprocal shield 83 moves relatively upward to enable the stamp block 802 to be in contact with the document. After usage, by releasing the grip portion 81, the reciprocal shield 83 will return to conceal the ink reservoir 801 and the stamp block 802. Though this kind of signet does not need a separate pad, it has a disadvantage in that the signet has to be discarded eventually because it can not be utilized any more after the ink reservoir 801 is depleted.

To overcome the above drawbacks, a kind of ink-replenishable signet was developed, which has a structure as shown in FIG. 8. The ink-replenishable signet includes a base 90 receiving a pedestal 91. The pedestal 91 has a tubular post 92 extending upward from a center thereof and a stop 921 is received in a top end of the post 92. A reed 94 is secured on the tubular post 92 by a clip 95 and is located via a plurality of columns 93 extending from the pedestal 91. A grip portion 96 is mounted on the base 90 and engaged with the top end of the tubular post 92 of the pedestal 91. The base 90 further has an ink reservoir 911 and a stamp block 912 received in the pedestal 91 and a cover 97 mounted to a bottom of the base 90 for sealing the stamp block 912. When the signet is to be used, the cover 97 can be removed. By pressing down the grip portion 96, the base 90 will relatively move upward to enable the stamp block 912 to be contact with a document. After usage, by releasing the grip portion 96, the reciprocal shield 90 will return to conceal the ink reservoir 801 and the stamp block 802 by means of an elastic force from the reed 94. When the ink reservoir 911 is depleted, the stop 921 is removed and fresh ink can be deposited through the tubular post 92 into the ink reservoir 911. Though this kind of signet can avoid problem of waste, it has a disadvantage in that the reed 94 may cause the force applying to the signet to become unevenly distributed during operation of the signet, therefore causing the seal on the document to be vague. A second shortcoming of this signet is that the fresh ink may not be spreaded uniformly throughout the ink reservoir 911. Another disadvantage of the signet is that an ink output may be excessive when a large pressure applied onto the grip portion 96, because the projection of the stamp block 912 is not restricted.

The present invention provides an improved ink-replenishable signet to mitigate and/or obviate the aforementioned problems.

SUMMARY OF THE INVENTION

One object of the present invention is to provide an improved ink-replenishable signet which has an even and stable ink output, thereby enabling the impression formed by signet to be clear.

In accordance with one aspect of the present invention, an ink-replenishable signet includes a body, a reciprocal shield movably receiving the body, a grip portion mounted on the reciprocal shield and a bottom cover mounted to a bottom of the reciprocal shield. The body comprises a pedestal, two rectangular tubes extending integrally and upwardly from the pedestal and a post formed between the two rectangular tubes. The pedestal further has an ink reservoir and a stamp block received therein and two stepped portions respectively formed at two sides thereof. A stop is mounted to the two stepped portions of the pedestal for restricting the movement of the stamp block. The reciprocal shield has an enclosure extending integrally from a top face thereof The top face of the reciprocal shield defines an aperture and two holes therein for the post and the two rectangular tubes of the pedestal to respectively extend therethrough. The extended post has a spring mounted thereon and is engaged with a clip member.

Other objects, advantages and novel features of the invention will become more apparent from the following detailed description when taken in conjunction with the accompanying drawings.

DETAILED DESCRIPTION OF PREFERRED EMBODIMENT

Figure 1:
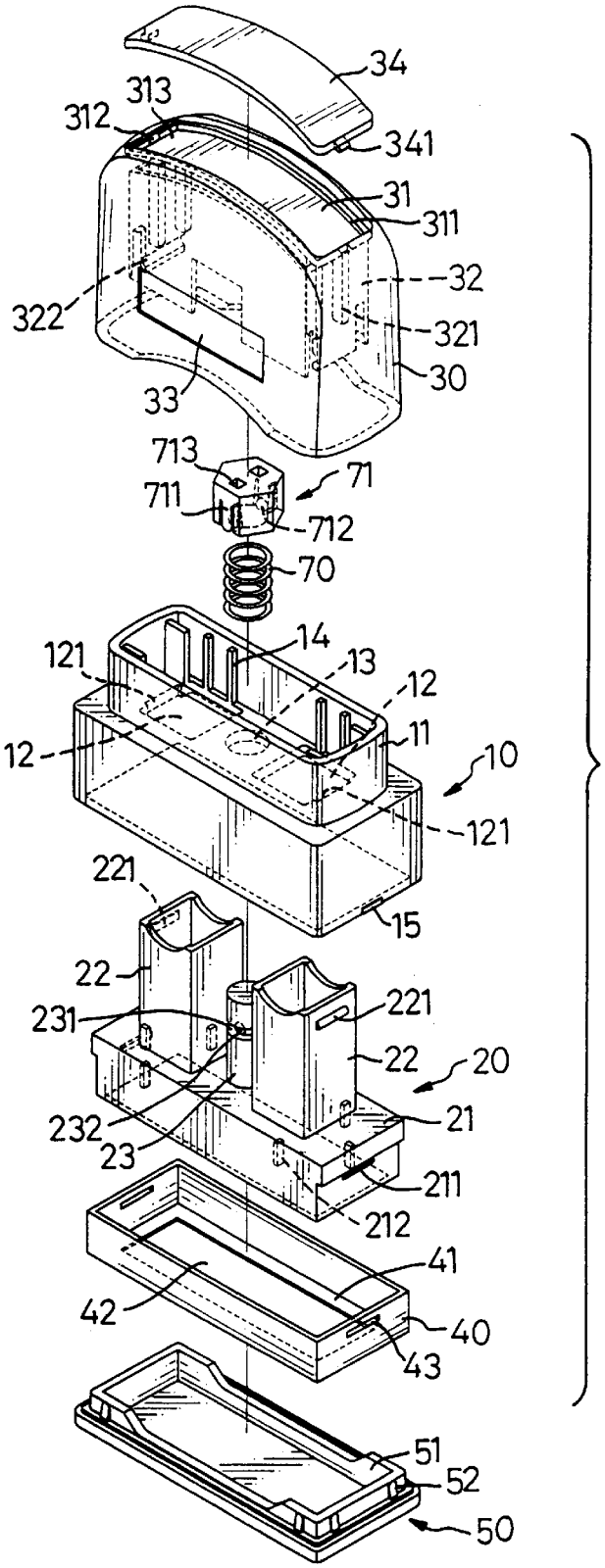
FIG. 1 is an exploded perspective view showing an ink-replenishable signet in accordance with the present invention.

Referring to FIG. 1, an ink-replenishable signet in accordance with the present invention is composed of a reciprocal shield 10, a body 20, a grip portion 30, a stop 40 and a bottom cover 50.

The body 20 includes a pedestal 21 configured hollow and substantially rectangular, wherein a bottom face of the pedestal 21 is open. An inner periphery of the hollow pedestal 21 has a plurality of reinforcement ribs 212 formed thereon. Two rectangular tubes 22 and a post 23 therebetween extend integrally and upwardly from the pedestal 21. The two rectangular tubes 22 are in communication with the pedestal 21 and respectively have a ridge 221 formed on an outer face furthermost from the post 23. A circumferential channel 231 is defined in an outer circumference of the post 23 at an appropriate portion thereof. A periphery defining the circumferential channel 231 further defines two orifices 232 therein. The pedestal 21 further has two stepped portions (not numbered) respectively formed at two sides thereof. Each of the stepped portions has formed an inclined strip 211 thereon.

The reciprocal shield 10 is also configured hollow and has an open bottom face for movably receiving the body 20. The reciprocal shield 10 has an enclosure 11 extending integrally from a top face thereof and a pair of protrusions 15 respectively extending from a lower portion of two outer sides thereof. The top face of the reciprocal shield 10 defines an aperture 13 and two holes 12 therein for the post 23 and the two rectangular tubes 22 of the pedestal to respectively extend therethrough, wherein a periphery defining each aperture 13 defines a cutout 121 to allow a corresponding ridge 221 of the rectangular tubes 22 to extend therethrough. A plurality of ribs 14 extend from an inner face of the enclosure 11 for retaining the extended rectangular tubes 22 of the body 20, thereby locating the tubes 22.

The grip portion 30, which is also configured hollow and rectangular, is secured on the reciprocal shield 10. The grip portion 30 defines a cavity 31 in a top portion thereof for receiving therein a label 35 (see FIG. 2) representative of the signet. A circumferential lip 311 extends from a periphery defining the cavity 31. A pair of recesses 312 are respectively defined in two opposed sides of the periphery of the cavity 31, each recess 312 communicating with a slot 313. A transparent cover 34 is mounted on the grip portion 30 through which a user can observe the label 35 received in the cavity 31. The transparent cover 34 has two lugs 341 engagingly received in the respective slot 313 of the grip portion 30. The grip portion 30 further has an inner frame 32 extending downward from the periphery of the cavity 31. The inner frame 32 has a pair of locating plates 321 extending from two opposed sides of an inner periphery thereof and one of a pair of grooves 322 is respectively defined below a corresponding locating plates 321. In addition, the grip portion 30 may define a shallow dish 33 in a front thereof, through which the user may determine by feel the front of the signet without having to inspect an underface thereof.

The stop 40, which is configured to mate with the two stepped portions of the pedestal, is mounted to the body 20 and also can be received in the reciprocal shield 10. The stop 40 comprises a bottom face 41 and a rectangular enclosure (not numbered). The bottom face 41 defines a through hole 42 therein. The rectangular enclosure defines a pair of slots 43 in two opposed sides thereof for the pair of inclined strips 211 of the pedestal 21 to be respectively received therein.

The bottom cover 50 is mounted at a bottom of the reciprocal shield 10 for sealing the body 20 and the stop 40. The bottom cover 50 has a peripheral flange 51 extending upward therefrom and a plurality of beveled lugs 52 are formed on an outer face of the peripheral flange 51 for fastening in the reciprocal shield 10.

In addition, an ink reservoir 60, a cotton layer 61 and a stamp block 62 are sequentially disposed within the pedestal 21 of the body 20. The ink reservoir 60 is provided for retaining ink and the cotton layer 61 is provided conducting the ink from the ink reservoir 60 to the stamp block 62.

Figure 4:
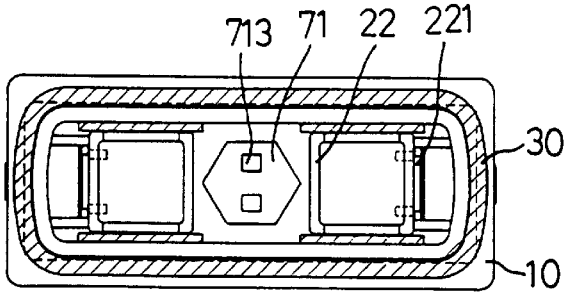
FIG. 4 is a sectional view showing the ink-replenishable signet taken from line 4—4 of FIG. 2.
Figure 2:
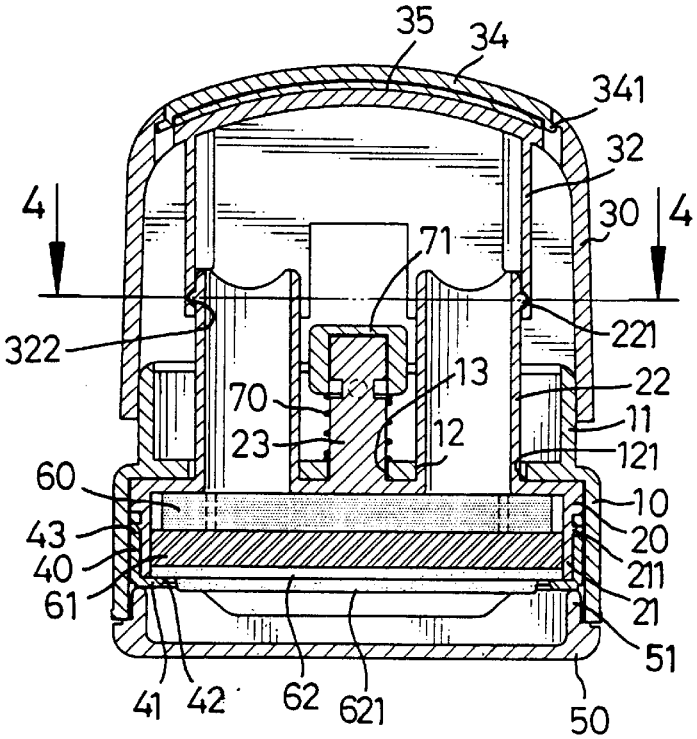
FIG. 2 is a front sectional view of the ink-replenishable signet in accordance with the present invention.
Figure 3:
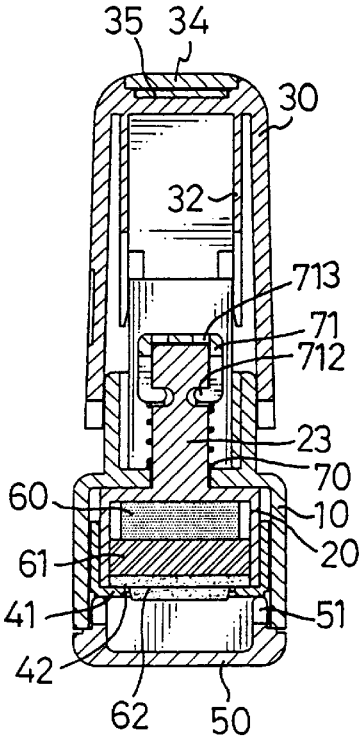
FIG. 3 is a side sectional view of the ink-replenishable signet of in accordance with the present invention.

In assembly, the ink reservoir 60, the cotton layer 61 and the stamp block 62 are initially disposed in the pedestal 21 of the body 20. Then the body 20 is received in the reciprocal shield 10. After the post 23 of the pedestal 21 extends through the aperture 13 of reciprocal shield 10, a spring 70 is mounted on the extended post 23 and then a clip member 71 can be used to engage with the extended post 23. The clip member 71 has two elastic strips 711 extending from two sides thereof. A bottom end of each elastic strip 711 has a boss 712 extending therefrom to be received in a corresponding orifice 232 of the post 23. With this arrangement, the clip member 71 can be snappingly engaged with the post 23 of the pedestal 21, as shown in FIGS. 2 and 3. Referring to FIG. 4, the clip member 71 further defines two blind holes 713 in a top face thereof through which a tool such as a screwdriver can be extended to remove the clip member 71 from the post 23. The stop 40 is mounted to the two stepped portions of the pedestal 21. Referring to FIG. 2, after the stop 40 is engaged with the pedestal 21, the stamp block 62 projects beyond the through hole 42 of the stop 40, but is concealed in the reciprocal shield 10. Thereafter, the grip portion 30 is applied on the reciprocal shield 10 such that the ridges 221 of the rectangular tube 22 of the pedestal 21 can be respectively received in the grooves 322 of the inner frame 32 of the grip portion 30. Finally, the bottom cover 50 is mounted to the bottom of the reciprocal shield 10.

Figure 5:
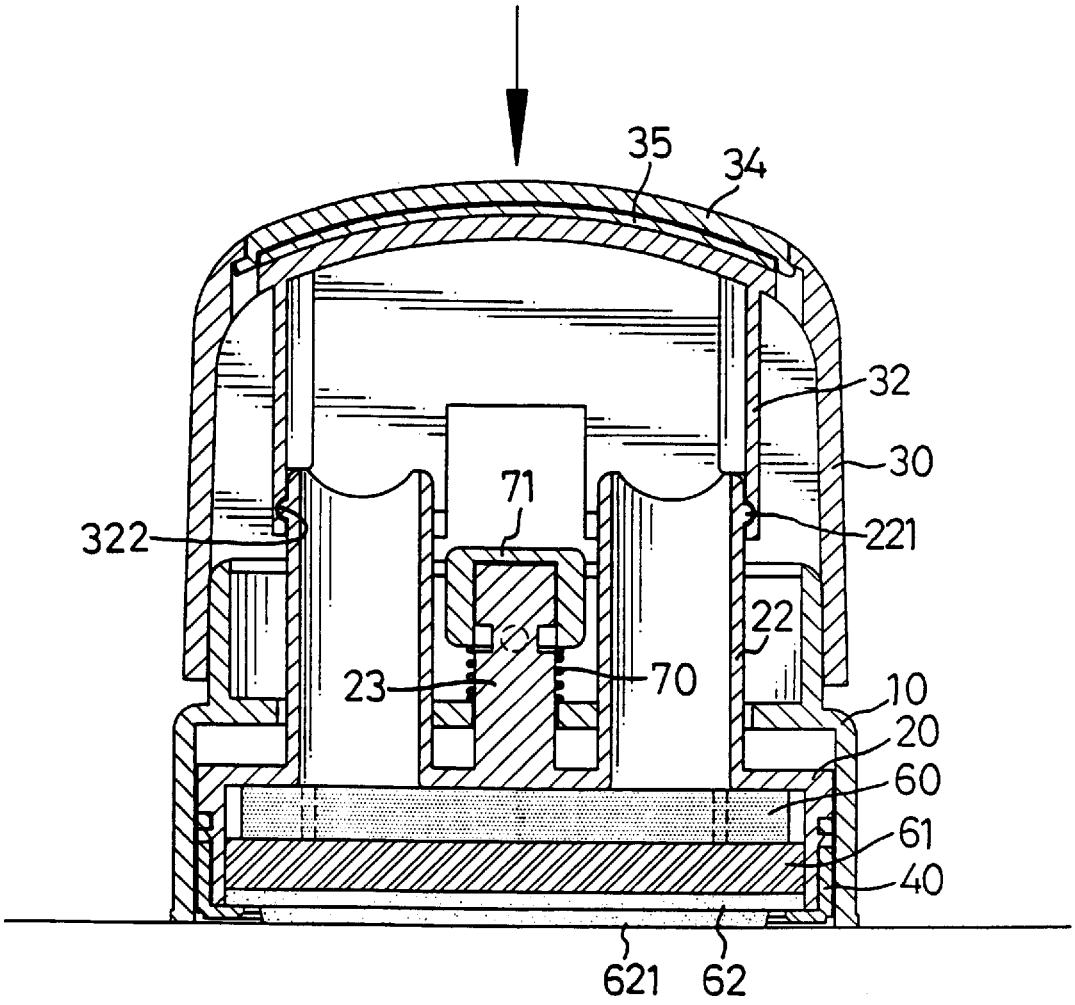
FIG. 5 is a sectional view showing the operation of the ink-replenishable signet in accordance with the present invention.
Figure 6:
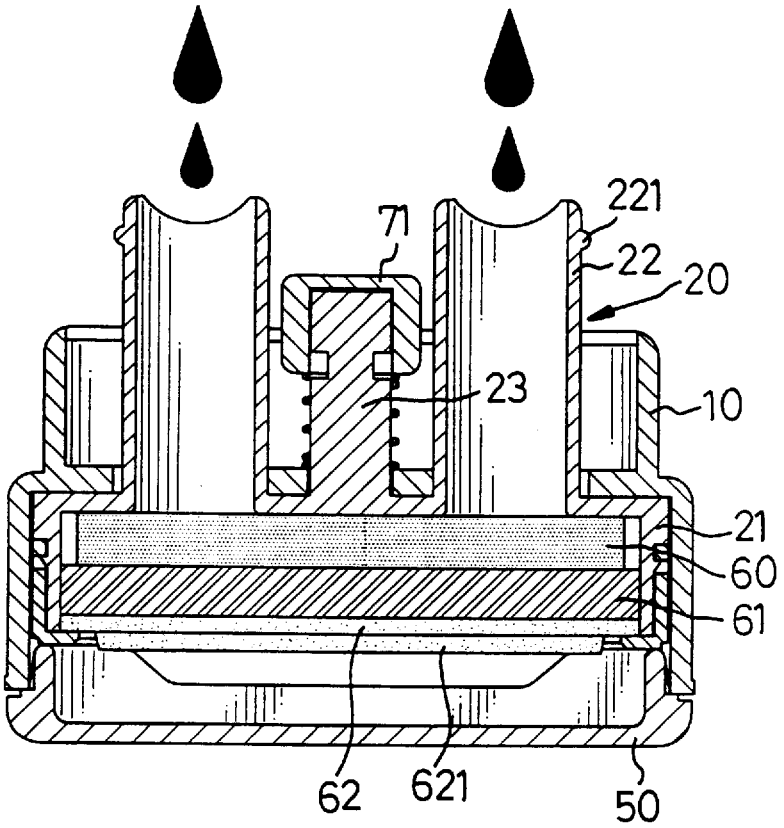
FIG. 6 is a sectional view showing a state of adding ink into the signet in accordance with the present invention.
Figure 7:
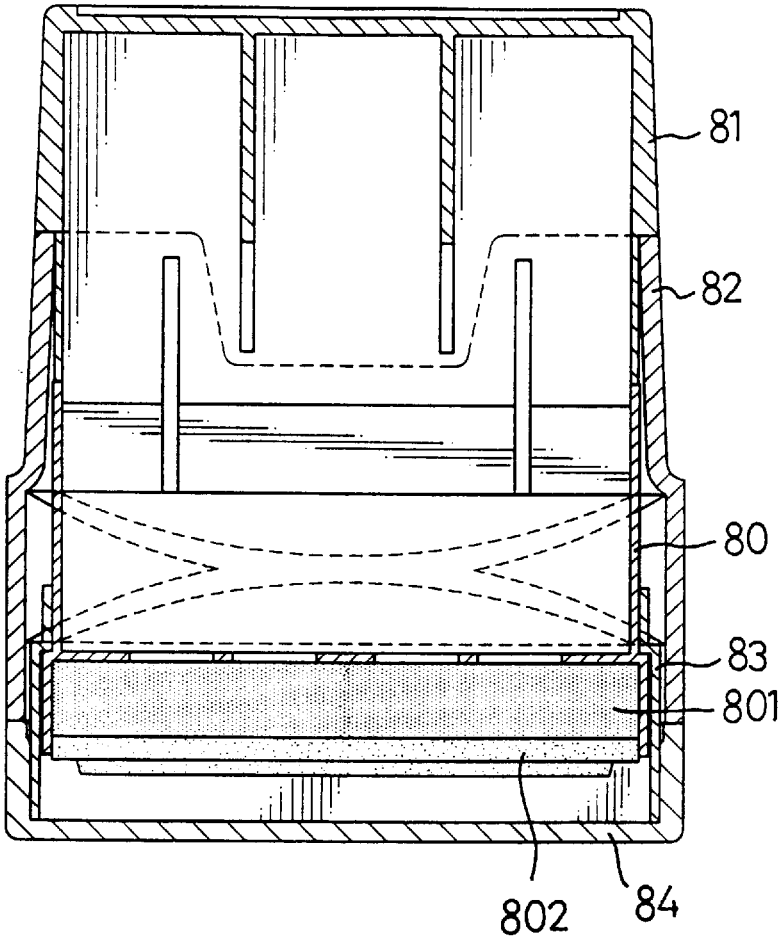
FIG.7 PRIOR ART
FIG. 7 is a sectional view showing a conventional signet.
Figure 8:
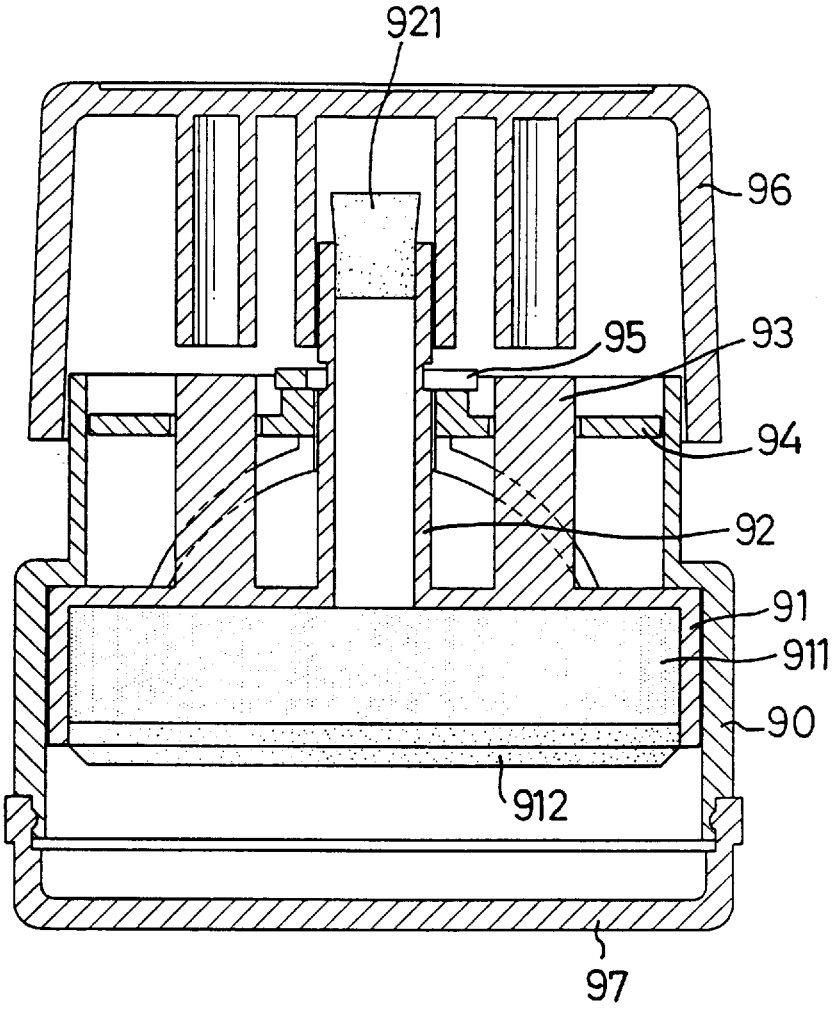
FIG.8 PRIOR ART
FIG. 8 is a sectional view showing an alternative conventional signet.

In use, the bottom cover 50 can be removed and the signet can be placed at an appropriate position of the document. Referring to FIG. 5, by pressing down the grip portion 30, an upward reactive force enables the reciprocal shield 10 to be lifted and the symbols 621 of the stamp block 62 to be extended and in contact with the document, whereby the stamping operation is accomplished. Since the stop 40 can restrict the movement of the stamp block 62, excessive ink output from the stamp block 62 can be avoided. Thereafter, by releasing the grip portion 30, the reciprocal shield 10 will return to conceal the pedestal 21 and the stamp block 62 due to elastic force from the spring 70. Referring to FIG. 6, the ink supply of the signet in accordance with the present invention is replenishable. By removing the grip portion 30 from the reciprocal shield 10, fresh ink can be deposited from the rectangular tube 22 of the pedestal 21 to the ink reservoir 60, whereby the cotton layer 61 can conduct the fresh ink to the stamp block 62 for usage.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ink-replenishable signet comprising:

a body including a pedestal, two rectangular tubes extending integrally and upwardly from the pedestal and a post formed between the two rectangular tubes, said pedestal further having an ink reservoir and a stamp block received therein and two stepped portions respectively formed at two sides thereof;

a stop mounted to the two stepped portions of the pedestal for restricting movement of the stamp block;

a reciprocal shield defining an open bottom for movably receiving said body and having an enclosure extending integrally from a top face thereof, said top face of the reciprocal shield defining an aperture and two holes therein for said post and said tubes respectively to extend through;

a clip member engaging said post;

a spring mounted over said post and engaging said clip member;

a grip portion mounted on said reciprocal shield; and a bottom cover mounted over the open bottom of said reciprocal shield to seal said body and said stop.

2. An ink-replenishable signet as claimed in claim 1, wherein said post of said body comprises a circumferential channel and two orifices each communicating with said circumferential channel, said clip member having two elastic strips extending from two sides thereof, each having a bottom portion formed with a boss extending therefrom to be received in a corresponding one of said two orifices of said post.

3. An ink-replenishable signet as claimed in claim 1, wherein said clip member further defines at least one blind hole.

4. An ink-replenishable signet as claimed in claim 1, wherein each of said rectangular tubes of said body respectively has a ridge formed on a periphery thereof, and said grip portion has an inner frame formed therein, said inner frame defining therein a pair of grooves for receiving said ridge of said respective rectangular tubes of said body, whereby said body can be engaged with said grip portion.

5. An ink-replenishable signet as claimed in claim 1, wherein said grip portion defines a cavity in a top portion thereof, said cavity having a pair of recesses formed respectively in opposed sides thereof and a slot defined in each of said recesses.

6. An ink-replenishable signet as claimed in claim 1, wherein said reciprocal shield further comprises a plurality of ribs extending from an inner periphery of said enclosure thereof for retaining said rectangular tubes of said body.

7. An ink-replenishable signet as claimed in claim 1, further comprising a cotton layer sandwiched between said ink reservoir and said stamp block for conducting ink from said ink reservoir to said stamp block.

8. The ink-replenishable signet of claim 3 comprising a tool adapted to be extended through said blind hole for removing said clip member from said post.

9. The ink-replenishable signet of claim 5 comprising a transparent cover mounted in said cavity of said grip portion and having two lugs each of which is engagingly received in a respective one of said recesses.

10. The ink-replenishable signet of claim 9 comprising a label representative of symbols of the signet, said label being received in said cavity and adapted to be observable by a user through said transparent cover.

* * * * *